United States Patent [19]

Ose

[11] 4,253,668

[45] Mar. 3, 1981

[54] TEE-UP APPARATUS FOR PRACTICING GOLF

[76] Inventor: Toshihiko Ose, 13-4 Negishi 2-chome, Taitoh-ku, Tokyo, Japan

[21] Appl. No.: 59,652

[22] Filed: Jul. 23, 1979

[30] Foreign Application Priority Data

Aug. 10, 1978 [JP] Japan ..... 53/109951[U]

[51] Int. Cl.[3] ..... A63B 57/00

[52] U.S. Cl. ..... 273/201; 294/19 A

[58] Field of Search ..... 273/201, 33, 32 B, 32 F, 273/162 E; 294/19 A

[56] References Cited

U.S. PATENT DOCUMENTS

| | | | |
|---|---|---|---|
| 1,863,140 | 6/1932 | Mulvaney | 273/33 |
| 2,760,807 | 8/1956 | Watson | 294/19 A |
| 2,810,252 | 10/1957 | Kelly | 294/19 A |
| 3,186,593 | 6/1965 | Miotke | 273/32 D |
| 3,458,204 | 7/1969 | Wilson | 273/201 |
| 3,547,314 | 4/1969 | Brandell | 273/32 F |

FOREIGN PATENT DOCUMENTS

| | | | |
|---|---|---|---|
| 23274 | of 1901 | United Kingdom | 294/19 A |
| 10661 | of 1902 | United Kingdom | 294/19 A |
| 1073545 | 6/1967 | United Kingdom | 273/201 |

*Primary Examiner*—Richard C. Pinkham
*Assistant Examiner*—T. Brown
*Attorney, Agent, or Firm*—Wyatt, Gerber, Shoup, Scobey & Badie

[57] ABSTRACT

Tee-apparatus for practicing golf comprises a ball pickup cylinder and a ball receiving base for teeing up golf balls individually thereon by depression of a lever. The ball pickup cylinder and the ball receiving base can be connected with each other by fitting part of a collar of the ball pickup cylinder into a concave portion formed in the ball receiving base.

6 Claims, 9 Drawing Figures

TEE-UP APPARATUS FOR PRACTICING GOLF

BACKGROUND OF THE INVENTION

The present invention relates to tee-up apparatus for use in practicing golf.

Conventionally, various types of devices for collecting stroked balls and apparatuses for teeing up balls automatically are known.

In particular, automatic tee-up apparatus capable of teeing up the balls supplied directly from a ball collecting device was previously proposed by the applicant of the present application in Japanese utility model application No. 46105/73 entitled "Tee-up Apparatus for Use in Practicing Golf."

According to the Japanese utility model application, a ball pickup cylinder and a ball receiving base of a tee-up apparatus can be connected with each other by fitting a cap of the ball pickup cylinder into a fitting hole formed in the ball receiving base. In this tee-up apparatus, it is necessary that the cap be attached to a base portion of the ball pickup cylinder through a shaft fixed to the ball pickup cylinder so that the cap can be opened and closed. On the other hand, in the ball receiving base it is necessary to form a hole for fitting the cap thereinto and when the cap has some accessories, such as a clasp, the holes for such accessories have to be formed in the ball receiving base.

SUMMARY OF THE INVENTION

It is therefore a principal object of the present invention to provide an improved tee-up apparatus which does not require the forming of complicated holes in the ball receiving base of the tee-up apparatus.

According to the invention, a collar is attached to a ball pickup cylinder and part of the collar is fitted into a concave portion formed in the ball receiving base, whereby the ball pickup cylinder and the ball receiving base can be connected with each other.

Therefore, it is unnecessary to form complicated holes for fitting therein the cap attached to the ball pickup cylinder as in the conventional tee-up apparatus proposed in the Japanese utility model application No. 46105/73.

DETAILED DESCRIPTION OF THE PREFERRED EMBODIMENTS

Figure 1:
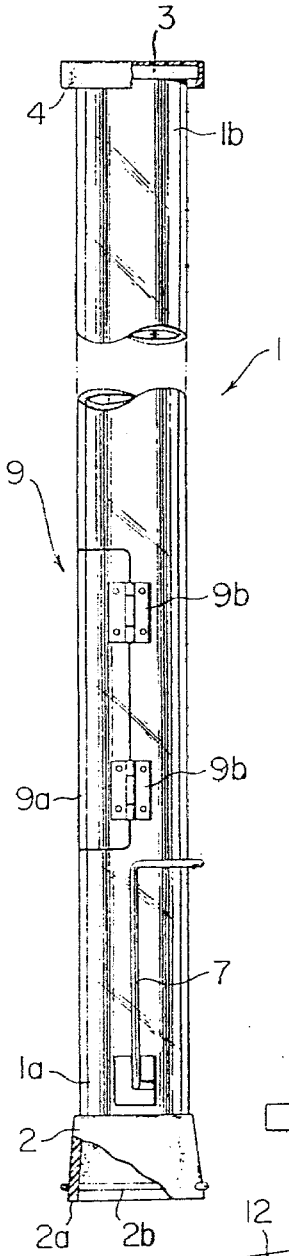
FIG. 1 is a partially cutaway illustration of a ball pickup cylinder of an embodiment of a tee-up apparatus according to the invention.
Figure 2:
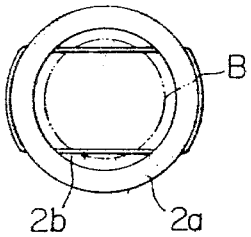
FIG. 2 is a rear elevation of the ball pickup apparatus of FIG. 1.
Figure 3:
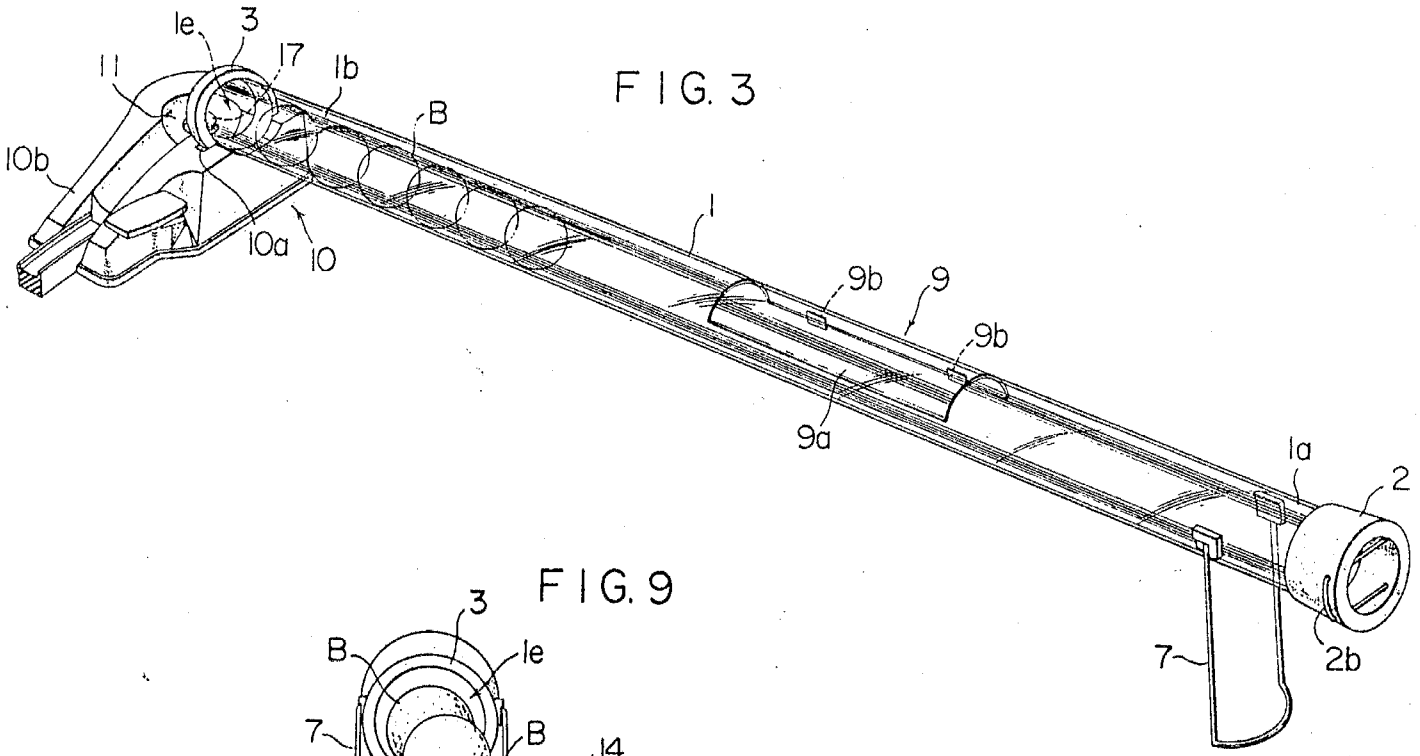
FIG. 3 is a perspective view of the embodiment of the tee-up apparatus of FIG. 1, which particularly shows that the ball pickup cylinder lying on the ground and connected to a ball receiving base.

Referring to FIGS. 1-3, there is shown an embodiment of a tee-up apparatus for practicing stroking golf balls according to the invention. The main components of the tee-up apparatus are a ball pickup cylinder 1 and a ball receiving base 10. The ball pickup cylinder 1 is a transparent cylinder made of synthetic resin cut in an appropriate length. Its inner diameter is slightly larger than the diameter of the ball. As illustrated in FIG. 1, a cylindrical ball trapping member 2 is attached to one end 1*a* of the ball pickup cylinder. As shown in FIG. 2, a pair of parallel elastic rubber bands 2*b* are stretched across an inlet portion 2*a* of the cylindrical ball trapping member 2, symmetrically with respect to the diameter of the inlet portion 2*a*, with distance between the rubber bands 2*b* being smaller than the diameter of the ball. The strength of the rubber bands 2*b* is such that the space between the rubber bands 2*b* is not widened by the weight of the maximum number of balls that can be kept in the ball pickup cylinder 1.

To the other end portion of the cylinder 1, there is a ring-shaped collar 3 whose diameter is greater than the outer diameter of the cylinder 1. A cap 4 is fitted on the collar 3. In this embodiment, the collar 3 is ring-shaped, but any shape is adoptable so long as part of the collar 3 is projected from the outer wall of the cylinder 1.

A folding leg 7 is disposed near the end portion 1*a* of the cylinder 1. The length of the folding leg 7 is such that when the cylinder 1 is laid on the ground with the leg 7 erected upright as shown in FIG. 3, the pickup cylinder 1 is inclined at an angle of approximately 10° with respect to the ground. On the opposite side of the leg 7, there is a ball charging portion 9 in the pickup cylinder 1. A lid 9*a* is disposed in the ball charging portion 9 with hinges 9*b*. The lid 9 can be opened to charge balls into the pickup cylinder 1.

Figure 6:
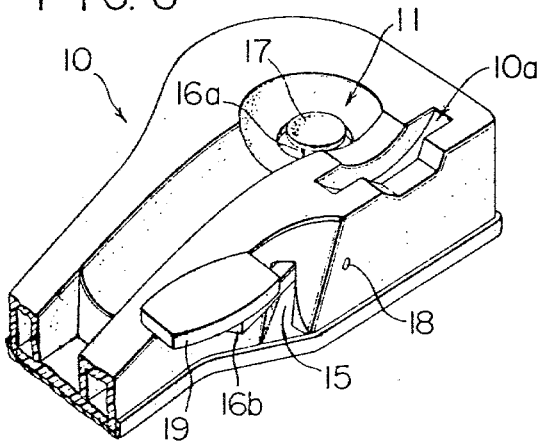
FIG. 6 is a perspective view of another ball receiving base for use in the invention.
Figure 5:
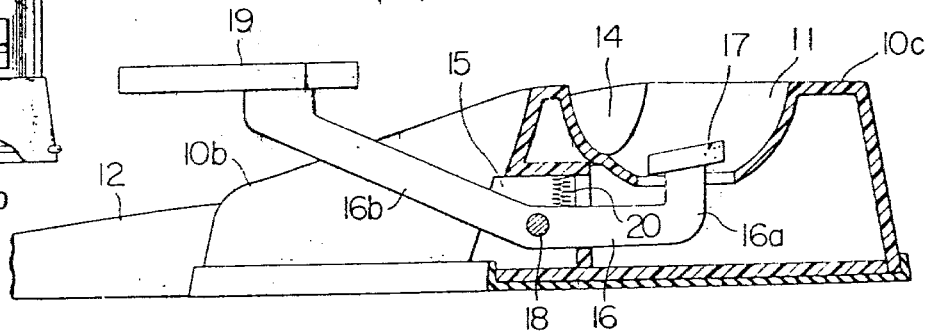
FIG. 5 is a sectional view taken along the lines V—V of FIG. 4.
Figures 4, 8:
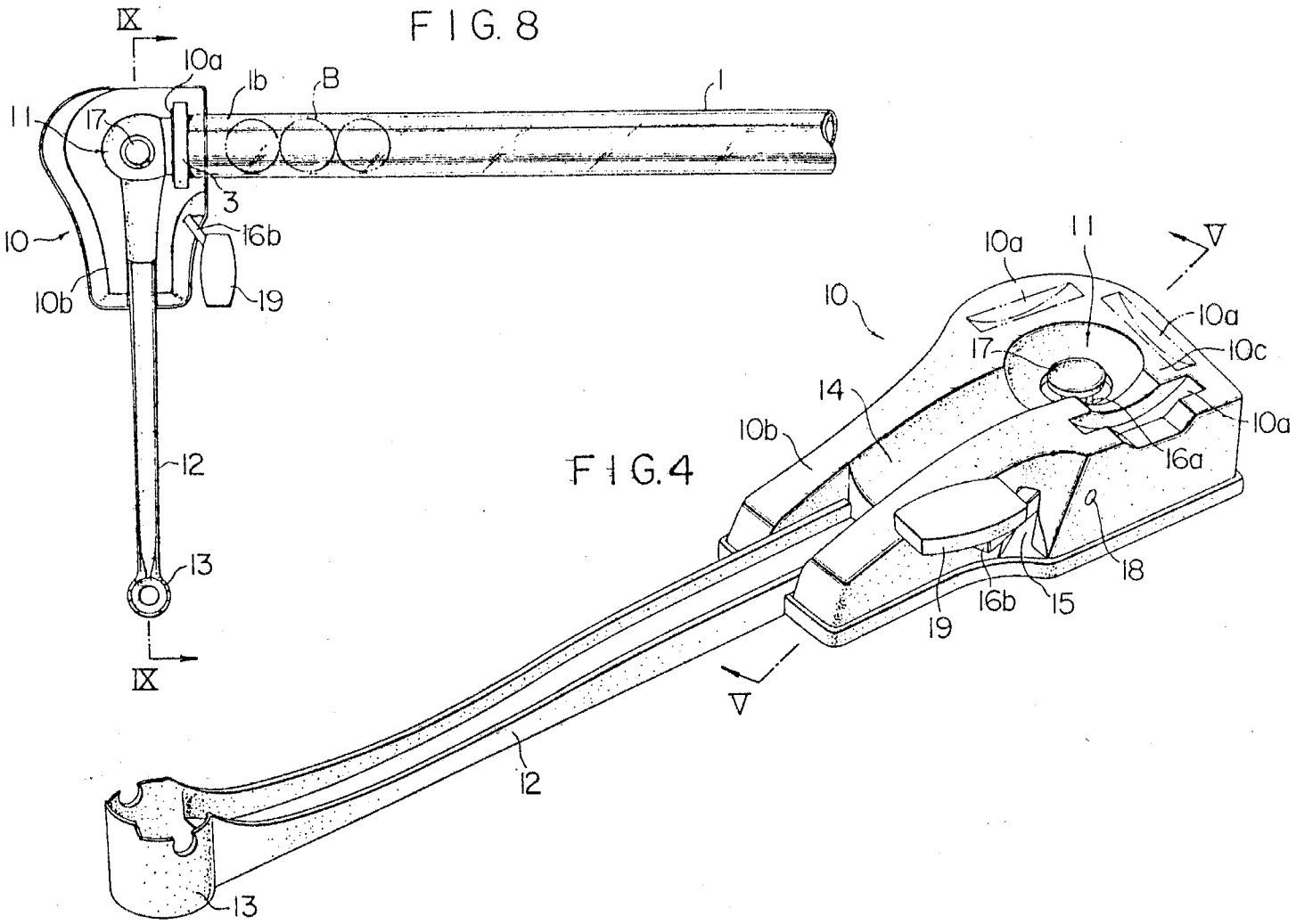
FIG. 4 is a perspective view of the ball receiving base of FIG. 3.
FIG. 8 is partial plan view of the ball receiving base connected to the ball pickup cylinder of the embodiment of FIG. 3.

Referring to FIGS. 4-6, a round ball receiving hole 11 is formed in the central portion of the ball receiving base 10. In a peripheral edge portion 10*c* of the ball receiving hole 11, there is a concave portion 10*a* in which part of the peripheral portion of the collar 3 can fit. The ball receiving base 10 extends in one radial direction of the ball receiving hole 11 and the extended portion of the base 10 constitutes a connecting portion 10*b* to which an elastic passageway or conduit 12 for leading balls is connected detachably. At the end portion of the conduit 12, there is a cup-shaped tee 13 integrally with the conduit 12. The length and inclination of the groove of the conduit 12 are set so that the ball does not go beyond the tee 13 when it rolls down the conduit 12. In the connecting portion 10*b*, there is a ball leading conduit 14 for leading the ball from the ball receiving hole 11 to the conduit 12.

In this embodiment, the concave portion 10*a* is formed in a position on the peripheral portion 10*c* at a right angle with respect to the line connecting the ball leading conduit 14 and the center of the ball receiving base 10. However, the concave portion 10*a* can be formed in any position of the peripheral portion 10*c*, except the connecting portion 10*b*, as illustrated in FIG. 4 by the alternate long and short dash line and by alternate long and two short dash line, so long as the concave portion 10*a* is in the radial direction from the center of the ball receiving hole 11. The concave portion 10*a* can be formed integrally with the ball receiving hole 11 by extending the ball receiving hole 11 as shown in FIG. 6 so as to permit part of the collar 3 to be engaged with the ball receiving hole 11.

Near the base of the connecting portion 10*b* of the ball receiving base 10, there is an opening 15 for allowing a U-shaped lever 16 to be inserted therein. More specifically, in the opening 15, the lever 16 is mounted on a shaft 18 fixed to the peripheral portion 10*c* as shown in FIG. 5. One end portion 16*a* of the U-shaped lever 16 extends upright at the center of the ball receiving hole 11 and a ball pushing member 17 is attached to the end portion 16*a*. The top surface of the ball pushing member 17 is inclined so as to be lower towards the ball leading conduit 14. A push-down member 19 is mounted on the other end portion 16*b* of the U-shaped lever 16. Inside the opening 15, there is a spring 20 for urging the end portion 16*a* of the U-shaped lever 16 downwards. When the push-down member 19 is pushed downwards, the lever 16 is swung about the shaft 18 so that the ball pushing member 17 attached to the end portion 16*a* of the U-shaped lever 16 is moved upwards at the center of the ball receiving hole 11. When the push-down member 19 is released, the ball pushing member 17 is returned to its original position by the resilience of the spring 20.

Figure 7:
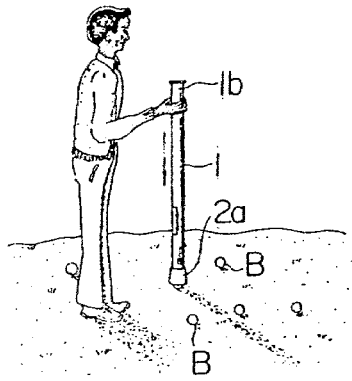
FIG. 7 illustrates how to pick up balls using the ball pickup cylinder of FIG. 1.
Figure 9:
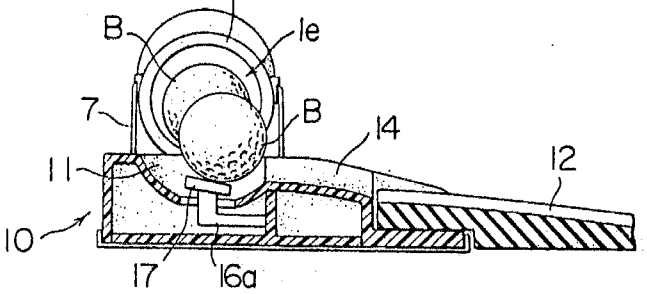
FIG. 9 is a partial sectional view taken along the lines IX—IX of FIG. 8.

Referring to FIG. 7, the use of the ball pickup cylinder 1 will be explained. As shown in FIG. 7, the pickup cylinder 1 can be held upright with the end portion 1*b* up, and the inlet portion 2*a* of the ball pickup cylinder 1 can be brought right onto a ball on the ground. The ball pickup cylinder 1 is then pushed downwards and the ball forces the rubber bands 2*b* apart to hold the ball therebetween. With a further pushing of the pickup cylinder 1, the ball is caused to pass through the rubber bands 2*b* and is held within the pickup cylinder 1. After the ball passes through the rubber bands 2*b*, the rubber bands 2*b* return to their original positions so that the space between the rubber bands 2*b* becomes smaller than the diameter of the ball. Therefore, the ball may not fall through the inlet portion 2*a*. Since the resilience of the rubber bands 2*b* is set so high that the rubber bands 2*b* can not be spread by the weight of all the balls that can be held in the ball pickup cylinder 1, the other balls lying on the ground can be picked up by the pickup cylinder 1 in the same procedure. Then, the pickup cylinder 1 is laid on the ground, with the leg 7 extended as shown in FIG. 3. The cap 4 is removed and a peripheral portion of the collar 3 can then be fit in the concave portion 10*a* of the ball receiving base 10 so that an opening portion 1*e* of the pickup cylinder 1 is aligned with the ball receiving hole 11, whereby the pickup cylinder 1 and the ball receiving base 10 are connected with each other. Since the end portion 1*b* of the pickup cylinder 1 is lower than the end portion 2*a* of the ball pickup cylinder 1, the ball B rolls down into the ball receiving hole 11, where the ball B is held by the ball pushing member 17 and the inner peripheral edge of the ball receiving hole 11 as shown in FIG. 9. In this condition, when the player pushes the push-down member 19, using his foot or his club, the lever 16, which is connected to the push-down member 19, is swung about the shaft 18, whereby the ball pushing member 17 attached to the end portion 16*a* of the lever 16 is moved upwards from the ball receiving hole 11. As a result, the ball B rolls down the ball leading conduit 14 and comes up to the tee 13, passing along the groove of the conduit 12. As mentioned previously, the length and inclination of the groove of the conduit 12 are such that the ball does not roll down beyond the tee 13. When the push-down member 19 is released, the lever 16 is returned to its original position by the spring 20.

Accordingly, the ball pushing member 17 returns to its original position in the ball receiving hole 11 after the ball has been rolled down from the ball pickup cylinder 1 to the ball receiving hole 11. In the same procedure as mentioned above, the ball is placed on the tee 13. When all the balls in the pickup cylinder 1 have been used up, balls can be charged through the ball charging portion 9 by opening the lid 9*a* and stroking the balls can be continued. When the stroking is finished, the collar 3 of the pickup cylinder 1 can be removed from the concave portion 10*a* of the ball receiving base 10, and the leg 7 folded back to its initial position. The conduit 12 can then be attached from the connecting portion 10*b* of the ball receiving base 10 complete dis-assembly. This tee-up apparatus thus can be separated into three parts quite easily, namely the ball pickup cylinder 1, the ball receiving base 10 and the conduit 12.

What is claimed is:

1. A tee-up apparatus for practicing stroking golf balls comprising:

a ball pickup cylinder having a diameter larger than the diameter of golf balls and having means at one end thereof for trapping golf balls within said ball pickup cylinder upon bringing said one end down over said golf balls, and a collar at the other end of said ball pickup cylinder, the diameter of said collar being larger than that of said ball pickup cylinder, a ball receiving base having a hole at the center thereof adapted to receive golf balls, a passageway for golf balls extending outwardly in a radial direction from the center of said hole to means for teeing up golf balls, and at least one concave portion formed in said ball receiving base and adapted to receive part of said collar to align the end of said cylinder adjacent said collar with said hole, said ball receiving base being detachable from said ball pickup cylinder, and a lever mounted pivotally on a shaft attached to said ball receiving base and having a push portion at one end thereof capable of moving upwards and downwards within said hole, and a pushed portion at the other end thereof being positioned outside said hole and adapted to be pushed downwards to pivot said lever and push any golf ball positioned within said hole onto said passageway and towards said teeing means.

2. A tee-up apparatus of claim 1, wherein said ball pickup cylinder is made of transparent resin material.

3. A tee-up apparatus of claim 1, wherein said ball trapping means comprises a cylindrical ball trapping member having an inlet portion therein, and a pair of parallel elastic bands which are stretched across said inlet portion, with the distance between said elastic bands being smaller than the diameter of golf balls.

4. A tee-up apparatus of claim 1, wherein said hole and said concave portion are formed integrally within said ball receiving base.

5. A tee-up apparatus of claim 1, wherein said push portion of said lever is normally urged downwards by a spring means and is moved upwards only when said pushed portion is depressed.

6. A tee-up apparatus of claim 1, wherein said push portion has a ball pushing member at the top thereof and the top surface of said ball pushing member is inclined so as to become lower towards said passageway.

* * * * *